United States Patent [19]

Urso

[11] 4,105,321

[45] Aug. 8, 1978

[54] ILLUMINATED CHARGE CONTROL SYSTEM FOR XEROGRAPHIC MACHINES

[75] Inventor: Charles J. Urso, Webster, N.Y.

[73] Assignee: Xerox Corporation, Stamford, Conn.

[21] Appl. No.: 736,033

[22] Filed: Oct. 27, 1976

[51] Int. Cl.[2] ..... G03G 15/02

[52] U.S. Cl. ..... 355/3 CH; 323/21

[58] Field of Search ..... 96/1 C; 323/21; 355/3 R, 3 CH, 3 DD, 3 BE, 16, 69; 361/225, 229

[56] References Cited

U.S. PATENT DOCUMENTS

| | | | |
|---|---|---|---|
| 3,604,925 | 9/1971 | Snelling et al. | 355/3 CH |
| 3,654,893 | 4/1972 | Piper et al. | 355/3 DD |
| 3,789,223 | 1/1974 | Sato | 96/1 C |
| 3,843,885 | 10/1974 | Sato et al. | 361/229 X |
| 3,944,354 | 3/1976 | Benwood | 355/3 DD |
| 4,008,954 | 2/1977 | Ogawa et al. | 355/3 R |
| 4,026,643 | 5/1977 | Bergman | 355/3 DD |

*Primary Examiner*—A. D. Pellinen

[57] ABSTRACT

Apparatus for controlling the charge level on the photoconductive surface of a reproduction machine to enhance imaging. A corona generator is used to initially charge the photoconductive surface following which the charge is examined and compared with a preselected reference charge. Where an overcharge is found, a lamp, the illumination intensity of which is matched to the degree of overcharge, is actuated to reduce the charge level on the photoconductive surface to substantially the same as the reference charge. The discharge lamp may be combined with the corona generator or be provided separate therefrom. An alternate embodiment has a lamp providing a fixed illumination output is provided with a liquid crystal interposed between the photoconductive surface and the lamp to control the degree of illumination to which the photoconductive surface is subjected.

2 Claims, 4 Drawing Figures

ILLUMINATED CHARGE CONTROL SYSTEM FOR XEROGRAPHIC MACHINES

This invention relates to electrostatic reproduction machines, and more particularly to an improved charge control system for use with such machines.

In an electrostatic or xerographic type reproduction machines or copiers, the charge level on the machine photoconductive surface or photoreceptor, is critical to satisfactory operation of the machine. As known to those versed in the art, the photoconductive surface is first charged, desirably to a preset charge level, preparatory to imaging. The level of this initial charge however, is often critical since too low a charge may result in weak, washed out looking copies whereas too high a charge may result in dark copies and overloading of the machine cleaning mechanism.

Normally the charge as aforesaid is placed on the photoconductive surface by a corona generator. Close control over the corona output of devices of this type is often difficult, particularly as the machine components including the corona generator age.

It is therefore a principle object of the present invention to provide a new and improved charge control for xerographic type machines.

It is a further object of the present invention to provide an improved charge control wherein the initial charge set down by the corona generator is examined and reduced as necessary by an illuminator whose illumination intensity is matched to the degree of overcharge.

It is an object of the present invention to provide an improved mechanism for reducing charges on a photoreceptor surface. It is an object of the present invention to provide a charge control wherein charges above a preset level are reduced by means of light having an intensity proportional to the overcharge.

This invention relates to an electrostatic type reproduction machine for producing copies of an original, comprising in combination, a photoreceptor; means for charging the photoreceptor in preparation for imaging; exposure means for exposing the charged photoreceptor to the original whereby to create a latent electrostatic image of the original on the photoreceptor; developing means for developing the latent electrostatic image on the photoreceptor; transfer means for transferring the developed image to a sheet of copy material; means for generating a charge level signal reflecting the charge level of the photoreceptor following charging by the charging means; light means for illuminating the photoreceptor to reduce the charge level of the photoreceptor, the light means reducing the charge level on the photoreceptor in proportion to the intensity of the light produced by the light means; and control means for regulating the intensity of the light means in response to the charge level signal.

Other objects and advantages will be apparent from the ensuing description and drawings in which.

Figure 1:
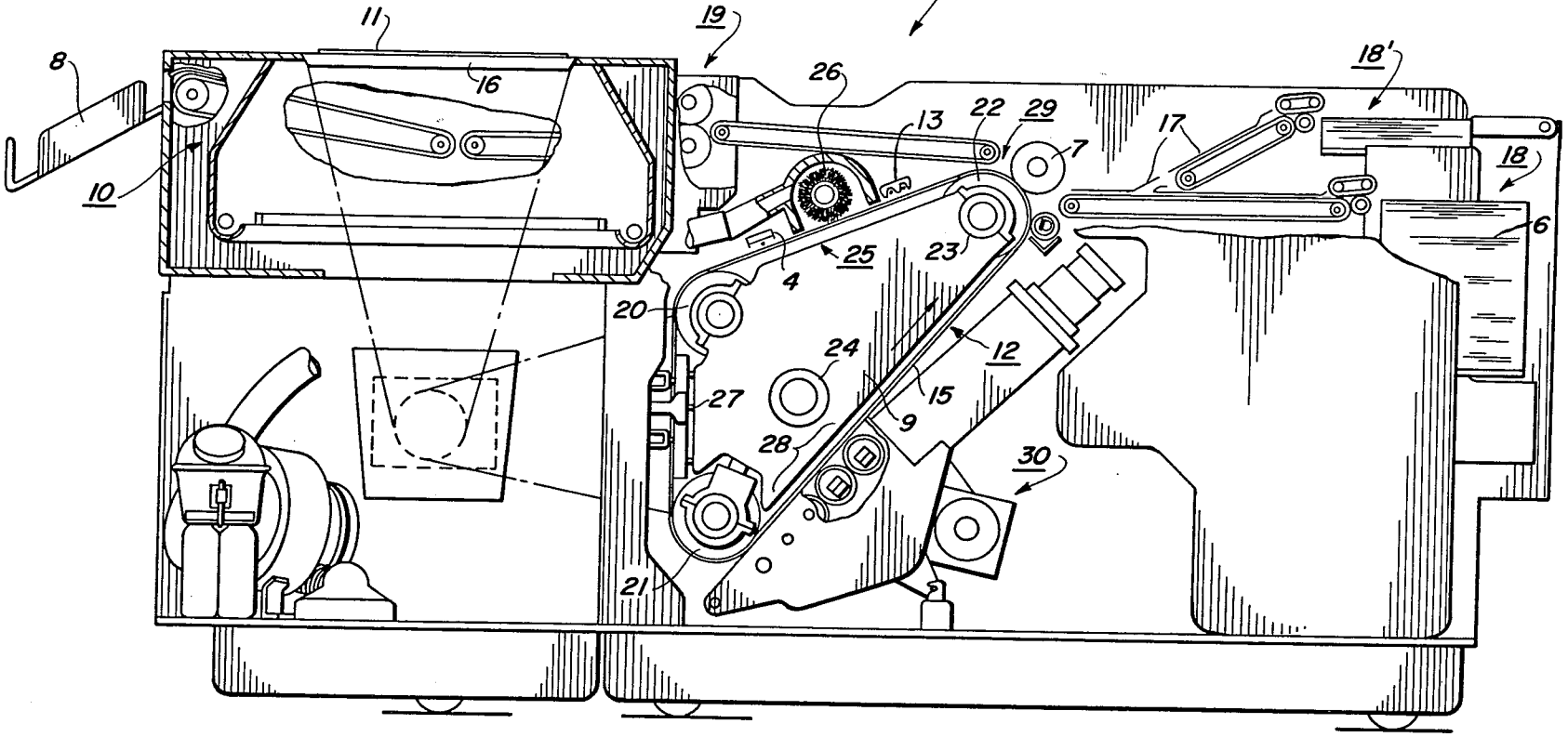
FIG. 1 is a schematic sectional view of an electrostatic reproduction machine incorporating the charge control system of the present invention.

For a general understanding of the invention, an exemplary copier/reproduction machine in which the invention may be incorporated, is shown in FIG. 1. The reproduction or copying machine, is there designated generally by the numeral 5.

A document 11 to be copied is placed upon a transparent support platen 16 fixedly arranged in an illumination assembly, generally indicated by the reference numeral 10, positioned at the left end of the machine 5. Light rays from an illumination system are flashed upon the document to produce image rays corresponding to the information areas. The image rays are projected by means of an optical system onto the photosensitive surface of a xerographic plate in the form of a flexible photoconductive belt 12 arranged on a belt assembly, generally indicated by the reference numeral 9.

The belt 12 comprises a photoconductive layer 15 of selenium which is the light receiving surface and imaging medium for the apparatus, on a conductive backing. The surface of the photoconductive belt is made photosensitive by a previous step of uniformly charging the same by means of a corona generating portion 13 of charge control device 4.

The belt is journaled for continuous movement upon three rollers 20, 21 and 22 positioned with their axis in parallel. The photoconductive belt assembly 9 is slidably mounted upon two support shafts 23 and 24, with the roller 22 rotatably supported on the shaft 23 which is secured to the frame of the apparatus and is rotatably driven by a suitable motor and drive assembly (not shown) in the direction of the arrow at a constant rate. During exposure of the belt 12, the reflected light image of such original document positioned on the platen is flashed on the surface 15 of belt 12 to produce an electrostatic latent image thereon at exposure station 27.

The electrostatic latent image on the moving belt 12 passes through a developing station 28 in which there is positioned a magnetic brush developing apparatus, generally indicated by the reference numeral 30, and which provides development of the electrostatic image by means of multiple brushes as the same moves through the development zone.

The developed electrostatic image is carried on belt 12 to transfer station 29 whereat a sheet 6 of copy paper is fed between transfer roller 7 and belt 12 at a speed in synchronism with the moving belt to transfer the developed image to sheet 6 without blurring. A sheet transport mechanism, generally indicated at 17, brings sheets 6 from paper supply tray 18 or 18' to the transfer station 29 at the proper time to match the arrival of the sheet with the arrival of the developed image on belt 12.

Following transfer, the image bearing sheet is separated from belt 12 and conveyed to a fuser assembly, generally indicated by the reference numeral 19, wherein the developed powder image on the sheet is permanently affixed thereto. After fusing, the finished copy is discharged from the apparatus into a suitable collector, i.e. tray 8. Residual toner particles and any other residue left on belt 12 are removed by brush 26 at cleaning station 25. Further details regarding the structure of the belt assembly 9 and its relationship with the machine and support therefor may be found in U.S. Pat. No. 3,730,623 issued May 1, 1973 and assigned to the same assignee.

As will be understood by those skilled in the art, development of the latent electrostatic image formed on belt 12 is dependent upon the voltage differential between the light image and the developing means. This voltage differential, which may be described as a xerographic development field, serves to attract toner to the latent electrostatic image in accordance with the image outline and density requirements to faithfully reproduce the original being copied.

Figure 2:
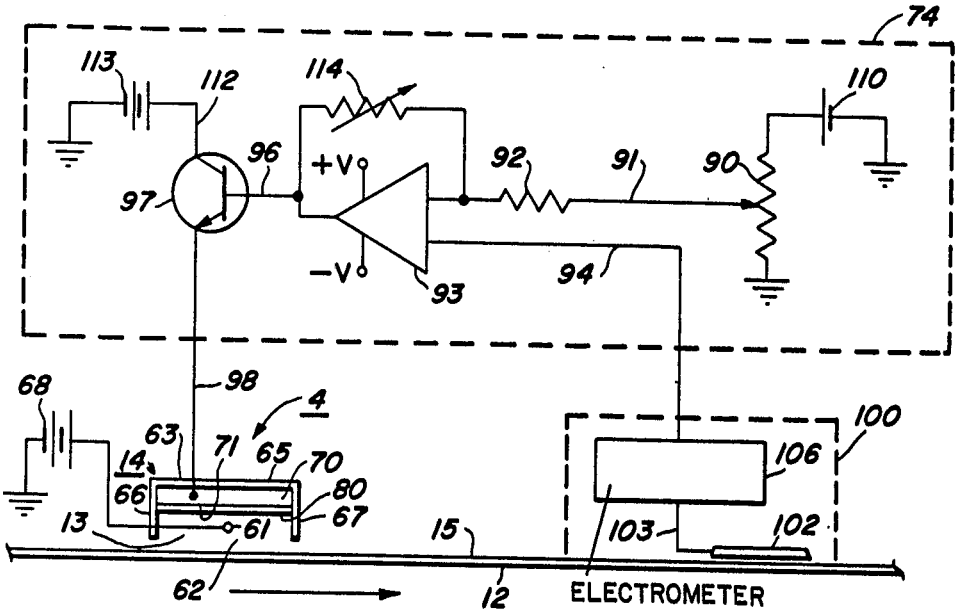
FIG. 2 is a circuit schematic of one embodiment of the charge control system of the present invention.
Figure 3:
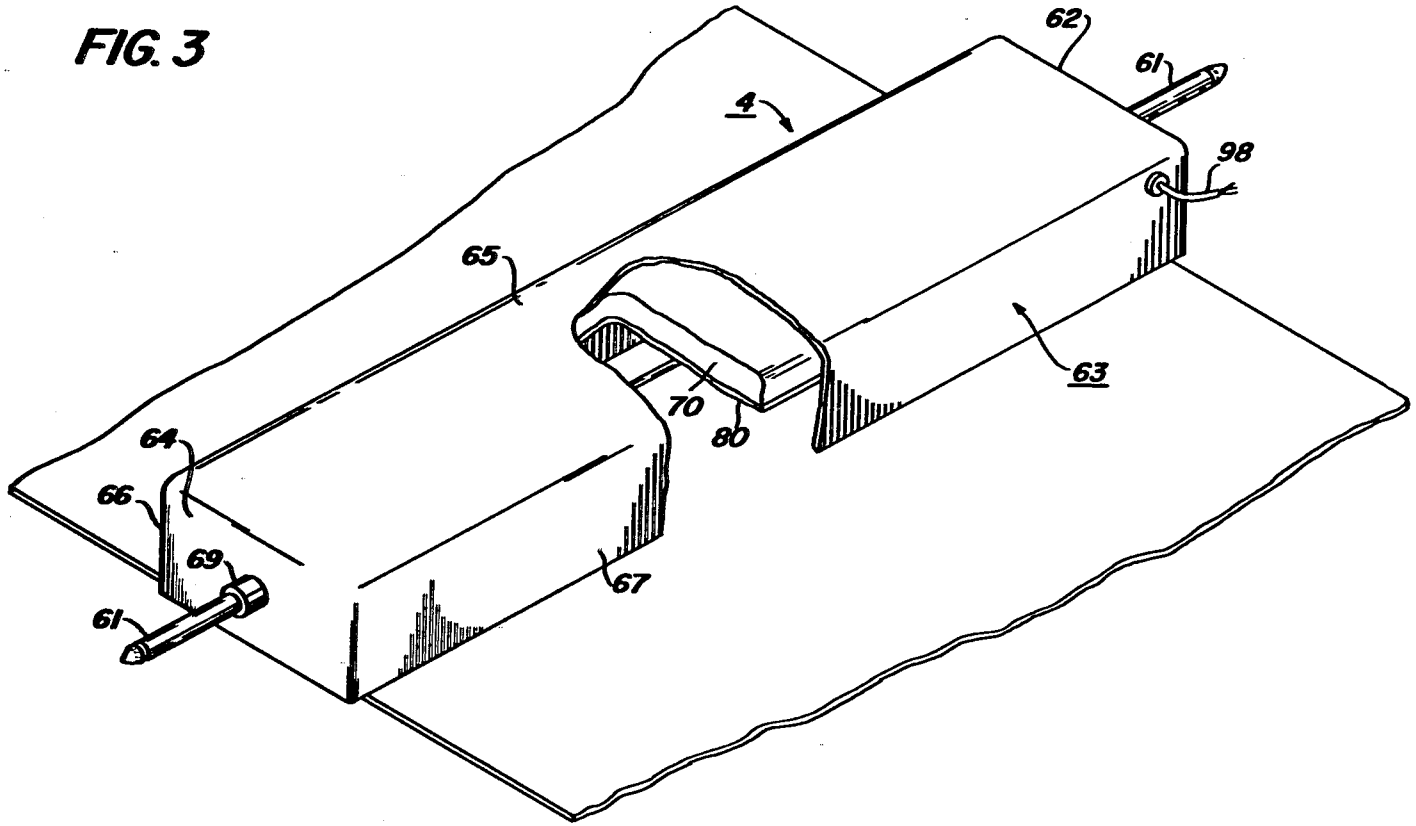
FIG. 3 is an isometric view showing details of the combination corona generator and discharge lamp of the present invention.

Referring now to FIGS. 2 and 3 of the drawings, charge control device 4 includes corona generating and charge control sections 13, 14 respectively. Corona generating section 13 includes a corona discharge wire 61 and adjoining shield 63. Shield 63 is formed from metal and in the arrangement shown, has, when viewed in cross-section, a generally inverted U-shape with top wall 65, depending side walls 66, 67, and end walls 62, 64. Corona wire 61, which is electrically coupled to a suitable d.c. power source, represented in exemplary fashion by battery 68, is strung between end walls 62, 64 of shield 63. To prevent shorting of corotron wire 61 to metal shield 63, suitable electrical insulators 69 are provided between wire 61 and the ends 62, 64 of shield 63. It will be understood that where corotron shield is composed of an electrical insulating material such as plastic, insulators 69 and, as will appear conductive layer 80, may be dispensed with.

Charge control section 14 includes a generally rectangular electro-luminescent panel 70, the length and width dimensions of which are equal to or slightly less than the corresponding length and width dimensions of shield 63, mounted within the shield interior on the inside surface of the shield upper wall 65. Panel 70 is electrically connected to a variable power supply 74 by lead 98. One suitable electroluminescent panel is type 94-0150-1 manufactured by Grimes Manufacturing Co., Urbana, Ohio.

To prevent build-up of static electrical charges on the electro-luminescent panel 70, the exposed or lower surface 71 of panel 70 is covered with a clear conductive material, preferably a thin layer 80 of NESA glass. Conductive layer 80 is electrically coupled to shield 63 through contact with side walls 66, 67 of shield 63. It will be understood that where shield 63 is formed from a non-conductive material, i.e. plastic conductive layer 80 may be dispensed with.

Power supply 74 comprises any suitable a.c. or d.c. power source. In the circuit illustrated, a suitable source of d.c. control voltage shown in exemplary fashion as battery 110 is provided. Battery 110 is coupled across voltage level controller 90, controller 90 serving to regulate the control voltage inputted to voltage comparator 93 in accordance with the setting thereof. The output signal of controller 90 in lead 91 thereof, which serves as a reference potential, is coupled through resistor 92 with one input of voltage comparator 93.

Lead 94 couples the other input of comparator 93 with the output of a device which generates an output signal indicative of the charge level on the photoconductive surface 15 of belt 12 following charging by corona generating section 13. In the exemplary arrangement shown, the charge measuring device comprises a d.c. type electrometer 100. Probe 102 of electrometer 100 is mounted in machine 5 in predetermined spaced relationship to the photoconductive surface 15 as will be understood by those skilled in the art. In a preferred embodiment, probe 102 is disposed downstream of the charge control device 4 but before developing station 30. Other probe locations, however, may be contemplated.

The d.c. signal output from probe 102, representative of the charge on the photoconductive surface 15, is inputted via lead 103 to the main body 106 of electrometer 100 wherein the signal is suitably amplified. The signal from electrometer 100 is fed to the input gate of comparator 93 through lead 94. One type of d.c. electrometer is described U.S. Pat. No. 3,852,668 issued Dec. 3, 1974 in the name of James M. Hardenbrook et al. Other electrometers including those of the a.c. type may instead be contemplated.

Comparator 93 may comprise any suitable circuit effective to compare voltage levels inputted thereto and generate an analog signal proportional to the difference between the input signal voltages. In the exemplary circuit illustrated, comparator 93 comprises an operational amplifier, operative to compare the signal outputs of voltage level controller 90 and electrometer 100, the latter signal bring representative of the charge level on the photoconductive surface 15 of belt 12. The signal output of comparator 93 is inputted through lead 96 to the base electrode of control transistor 97. Lead 98 couples the emitter of transistor to panel 70 while lead 112 couples the collector of transistor 97 to a suitable power source shown here as battery 113. Control transistor 97 regulates the power input to panel 70 in response to the output signal from comparator 93 to thereby control the level of illumination of panel 70. Variable resistor 114 controls gain of comparator 93.

During the operational cycle of reproduction machine 5, the photoconductive surface 15 of belt 12 is charged by the corona generating section 13 and exposed at exposure station 27 to the original 11 being copied to produce a latent electrostatic image of original 11 on the surface 15 of belt 12. The latent electrostatic image so formed is carried past developer station 28 whereat the image is developed. The developed image then passes to transfer station 29 where the developed image is transferred to a sheet 6 of copy paper brought forward from supply tray 18 or 18' by transport 17 at the proper time so as to assure registration of the developed image on belt 12 with the sheet 6. The copy sheet 6 bearing the developed image is thereafter transported to fuser 19 where the image is fixed, following which the final copy is discharged into tray 8.

Electrometer 100 monitors the charge level on the portion of the photoconductive surface 15 of belt 12 viewed by probe 102. The signal output of electrometer 100 is fed to comparator 93 where the signal from electrometer 100 is compared with the preset reference signal from voltage level controller 90. So long as the voltages of the signal inputs to comparator 93 are substantially identical, transistor 97 blocks the flow of current to panel 70. As a result, electro-luminescent panel 70 is held in the off condition.

Where the signal inputs to comparator 93 are unbalanced, reflecting charging of the photoconductive surface 15 to a level greater than that represented by the reference voltage in lead 91, transistor 97 feeds power to panel 70 in proportion to the change in signal in lead 96, the signal in lead 96 being proportional to the difference in potential between the signal in lead 91, and the signal in lead 94. The resulting current flow in lead 98 to the electro-luminescent panel 70 energizes panel 70 to produce an illumination whose intensity is proportional to the power input thereto. Illumination from panel 70 reduces the charge on the photoconductive surface 15 of belt 12 in proportion to the degree of illumination.

Figure 4:
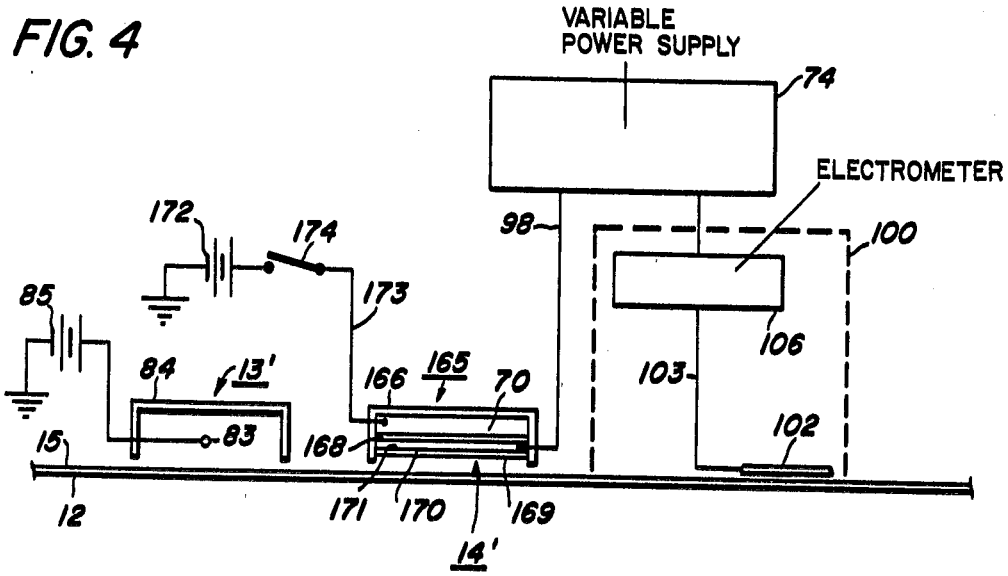
FIG. 4 is a circuit schematic of an alternate embodiment wherein a fixed light source with liquid crystal regulator is provided for controlling the intensity of the light shone upon the photoconductive surface.

While the charge generating and change control sections 13, 14 respectively are in a preferred embodiment combined to form a unitary device 4, it will be understood that sections 13, 14 may comprise discrete entities as in the arrangement shown in FIG. 4. There, the charge generating section comprises a corona generator 13' while the charge control section comprises a modified version 14' of the variable illumination device shown in FIGS. 1 - 3.

Referring now to FIG. 4, wherein like numerals refer to like parts, electro-luminescent panel 70 is mounted within a generally inverted U-shaped shield 165, panel 70 being disposed against the inside face of the shield upper wall 166. Shield 165 is supported by suitable means (not shown) in transverse relationship to belt 12 at some convenient point along the belt run. In the arrangement illustrated, shield 165 is disposed adjacent to and downstream of corona generator 13'.

As will appear, panel 70 serves as the source of illumination with control over the amount of light directed onto the photoconductive surface 15 of belt 12 being effected by means of liquid crystal 170 in response to the charge conditions of the photoconductive surface. In the FIG. 4 embodiment, the side of electro-luminescent panel 70 facing the photoconductive surface of belt 12 is overlayed with a liquid crystal 170, crystal 170 preferably being sized and configured so as to cover the entire side of panel 70. Suitable light polarizers 168, 169 such as manufactured by Polaroid Corporation under the trade name Polaroid sheet are disposed between panel 70 and liquid crystal 170, and on the side 171 of crystal 170 facing the photoconductive surface 15.

Liquid crystal 170 comprises any suitable liquid crystal of the so-called field effect type wherein the light transmissitivity thereof varies in response to the electric current applied thereof. A liquid crystal suitable for this purpose is manufactured by Hamlin, Inc., Lake Mills, Wisc.

In the arrangement shown, the light transmissitivity of liquid crystal 170, and hence the amount of light directed onto the photoconductive surface, is regulated in response to the charge conditions of the photoconductive surface 15. In FIG. 4, the output of variable power source 74, which is representative of the charge level of the photoconductive surface 15 of belt 12 as described heretofore, is applied via lead 98 to liquid crystal 170 to control the light transmissitivity thereof. Panel 70 in this embodiment serves as the light source and is driven from a suitable power source such as battery 172 through lead 173. On/off switch 174 in lead 173 permits panel 70 to be turned off, as during periods when machine 5 is not in use.

Corona generator 13' comprises any suitable d.c., a.c., or a.c./d.c. type corona charging device as known to those skilled in the copier arts. In the arrangement illustrated, the corona generating device 13' includes a corona emitting wire 83 supported within shield 84 and coupled to a suitable source of power, exemplified by battery 85.

In operation of the FIG. 4 embodiment, switch 174 is closed to energize electro-luminescent panel 70 continuously. The amount of light, if any, transmitted by liquid crystal 170 onto the photoconductive surface 15 is varied in response to the strength of the signal in output lead 98 of variable power supply 74, which in turn is representative of the charge level on the photoconductive surface 15.

Where the charge on surface 15 is at the level desired, the signal in lead 98 to crystal 170 causes molecular turbulence which renders crystal 170 opaque with the result that light from panel 70 to the photoconductive surface 15 is blocked. Where the signal in lead 98 reflects overcharging of the photoconductive surface 15, molecular reorientation of the molecules within crystal 170 proportional in degree to the signal strength occurs with the result that crystal 170 transmits a proportional amount of light from panel 70 therethrough onto the photoconductive surface 15. As described, the light reduces the charge level on the photoconductive surface 15 in proportion to the light intensity.

While in the FIG. 4 embodiment, the corona generator 13' is separate from the charge control 14', it will be understood that corona generating device 13' and charge control 14' may be combined as a single unit. In that event, shield 165 would be dispensed with and the liquid crystal 170 would instead be disposed inside shield 84 of corona generator 13'. In the event shield 84 is formed from a conductive material, a conductive transparent layer, such as the conductive layer 80 shown and described in the FIGS. 1 - 3 embodiment, would preferably be disposed over the polarizer 169 facing the photoconductive surface 15.

While the light source has been illustrated and described as comprising an electro-luminescent panel 70, other suitable light sources may be contemplated.

While the invention has been described with reference to the structure disclosed, it is not confined to the details set forth, but is intended to cover such modifications or changes as may come within the scope of the following claims.

What is claimed is:

1. In an electrostatic type reproduction machine for producing copies of an original, the machine having a photoreceptor, means for charging the photoreceptor in preparation for imaging, exposure means for exposing the charged photoreceptor to the original whereby to create a latent electrostatic image of the original on the photoreceptor, developing means for developing the latent electrostatic image on the photoreceptor, and transfer means for transferring the developed image to a sheet of copy material, the combination comprising:

a. means for generating a charge level signal reflecting the charge level of said photoreceptor following charging by said charging means;

b. light means for illuminating said photoreceptor to reduce the charge level of said photoreceptor, said light means reducing the charge level on said photoreceptor in proportion to the intensity of the light produced by said light means; and c. control means for regulating the intensity of said light means in response to said charge level signal, said light means comprising a constant light source, and variable light conducting means disposed between said light source and said photoreceptor, said control means including means for controlling the light transmissitivity of said light conducting means in response to said charge level signal.

2. The reproduction machine according to claim 1 in which said variable light conducting means comprises a liquid crystal.

* * * * *